United States Patent [19]

Mennesson

[11] 3,967,608

[45] July 6, 1976

[54] FUEL FEED DEVICES FOR INTERNAL COMBUSTION ENGINES

[75] Inventor: François Mennesson, Nanterre, France

[73] Assignee: Societe Industrielle de Brevets et d'Etudes S.I.B.E., Neuilly-sur-Seine, France

[22] Filed: Mar. 24, 1975

[21] Appl. No.: 561,183

[30] Foreign Application Priority Data

Mar. 25, 1974 France ..... 74.10141

[52] U.S. Cl. ..... 123/139 AW; 123/32 EA; 261/50 A

[51] Int. Cl.[2] ..... F02M 51/02

[58] Field of Search ..... 123/139 AW, 32 EA

[56] References Cited

UNITED STATES PATENTS

| | | | |
|---|---|---|---|
| 3,286,998 | 11/1966 | Mennesson | 123/139 AW |
| 3,288,445 | 11/1966 | Mennesson | 123/139 AW |
| 3,596,645 | 8/1971 | Mennesson | 123/139 AW |

*Primary Examiner*—Wendell E. Burns
*Assistant Examiner*—James W. Cranson, Jr.
*Attorney, Agent, or Firm*—Stevens, Davis, Miller & Mosher

[57] ABSTRACT

The fuel feed device comprises a butterfly valve actuated by the driver and an auxiliary throttle member which opens automatically in proportion to the rate of air-flow in the intake passage of the engine. The pressure of the fuel which is delivered into the intake at a location downstream of the butterfly by an injector is adjusted by an unloading valve. The fuel pressure tends to open the unloading valve and the under-pressure which prevails in a control chamber tends to close it. The control chamber has a connection with a portion of the intake which is located downstream of the auxiliary throttle member. That connection is open when the under-pressure is moderate. The connection has also a branch connected to an additional air channel for cold running of the engine which is open when the temperature of the engine is lower than a predetermined value.

6 Claims, 3 Drawing Figures

FUEL FEED DEVICES FOR INTERNAL COMBUSTION ENGINES

Figure 1:
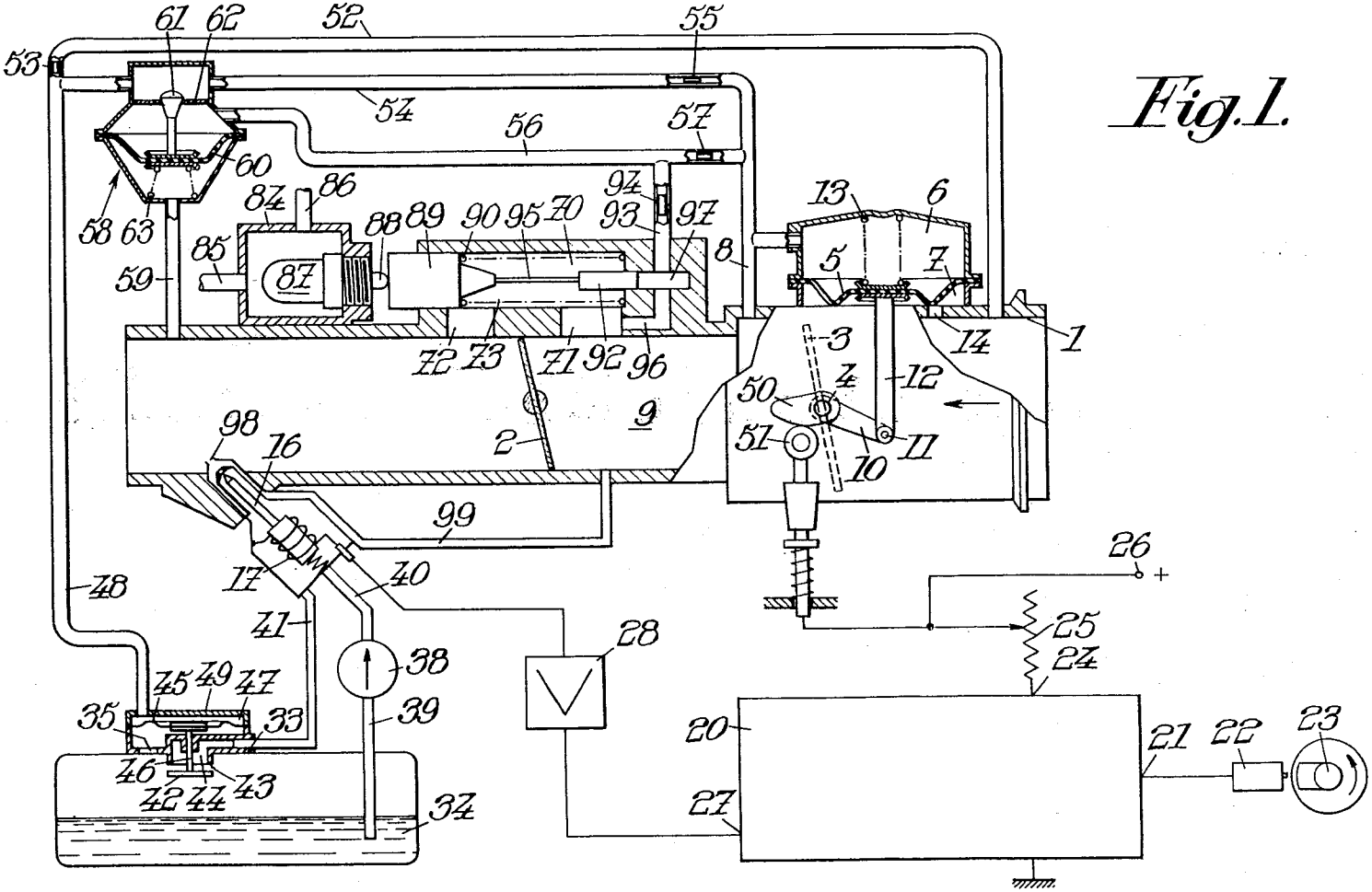

The invention relates to fuel feed devices for internal combustion engines which comprise auxiliary throttle means which opens automatically and progressively in proportion to the increase in the flow rate of air in the air intake of the engine and is disposed in the air intake passage upstream of driver actuated main throttle means, a source of fuel under pressure having delivery pipe means which terminates in a portion of the air intake located downstream of the main throttle means and is controlled by at least one solenoid actuated valve, and a metering system which is sensitive to the position of the auxiliary throttle means, is provided with means delivering a succession of pulses at time intervals and is adapted to supply the solenoid with an energisation signal during a fraction of each time interval, the fraction being adjusted by the metering system.

Fuel feed devices of the above type are known in which the means delivering a succession of pulses includes a member which is continuously driven in rotation, typically by the engine: the time interval is then the duration of a 360° rotation of the member.

The aforementioned fraction of the time interval or revolution determines the total time for which the valve is opened in a given time period, and consequently determines the quantity of fuel injected into the engine intake circuit during the same time period, at a given fuel flow rate per unit time.

The invention relates more particularly to devices of the aforementioned type wherein the source of fuel under pressure comprises a delivery pipe provided with a pressure regulator comprising a relief valve tending to open under the action of the pump delivery pressure and to close under the action of the under pressure which prevails in that part of the air intake between the two throttle means, the under pressure being transmitted by a first connecting pipe to a valve control chamber, bounded e.g., by a diaphragm coupled to the valve closure member.

The invention applies more particularly to devices of the aforementioned type which, for rendering cranking and cold-running of the engine easier, comprise an additional air duct having a flow cross-section which is automatically controlled by thermostatic means which is sensitive to the engine temperature and which closes the duct when the temperature reaches a given value, which is less than or at most equal to the normal operating temperature of the engine. An air flow can flow through that duct and by-pass the main throttle means, at least when the latter is in its minimum opening position.

It is known that, during operation at full load, it is desirable to use a richer air-fuel mixture than during operation under partial load, so as to obtain maximum engine power. A device for obtaining this object is described in U.S. Pat. No. 3,596,645 (Andre L. Mennesson). The device described in that specification comprises means for increasing, under full load, the under pressure which acts on the relief valve and which tends to close it and consequently to cut off the return from the pump to the fuel tank. The increase in under pressure is obtained by a capsule which is sensitive to the pressure downstream of the main throttle means. When such pressure reaches the value corresponding to full load, the capsule closes a leakage path tending to reduce the under pressure, and thus enriches the mixture.

When the engine is cranked, and until the engine has reached a limit temperature lower than its normal operating temperature, it is often necessary to enrich the mixture under full load, so as to obtain correct operation. As soon as the engine has reached its normal operating temperature, the resulting enrichment becomes too high to comply with the authorised limits for the emission of polluting gases such as carbon monoxide and unburnt hydrocarbons. For example, the device described in U.S. Pat. No. 3,596,645 does not give an enrichment which varies with temperature.

An object of the invention is to provide a supply device which meets practical requirements better than prior art devices, inter alia in that it provides satisfactory enrichment for full-load operation before the motor has reached the limit temperature, and reduces the enrichment for full-load operation when the engine is warm.

According to the invention, there is provided a device of the aforementioned type wherein the relief-valve control chamber is also connected to the inlet of the air intake passage via a second pipe and is connected to that part of the air intake passage which is between the main and auxiliary throttle means by a third pipe provided with means which opens or closes it depending on whether the under pressure in that part of the air intake downstream of the main throttle means is lower or higher than a threshold and a connecting pipe is provided between the third pipe and that part of an additional air duct used for cold starting which is disposed upstream of an adjustment cross-section thereof, means sensitive to the engine temperature being provided to close the connecting pipe when the latter exceeds a limit value.

The invention will be better understood from the following description and accompanying drawings, both the description and the drawings relating to an illustrative embodiment.

In the drawings

Figure 2:
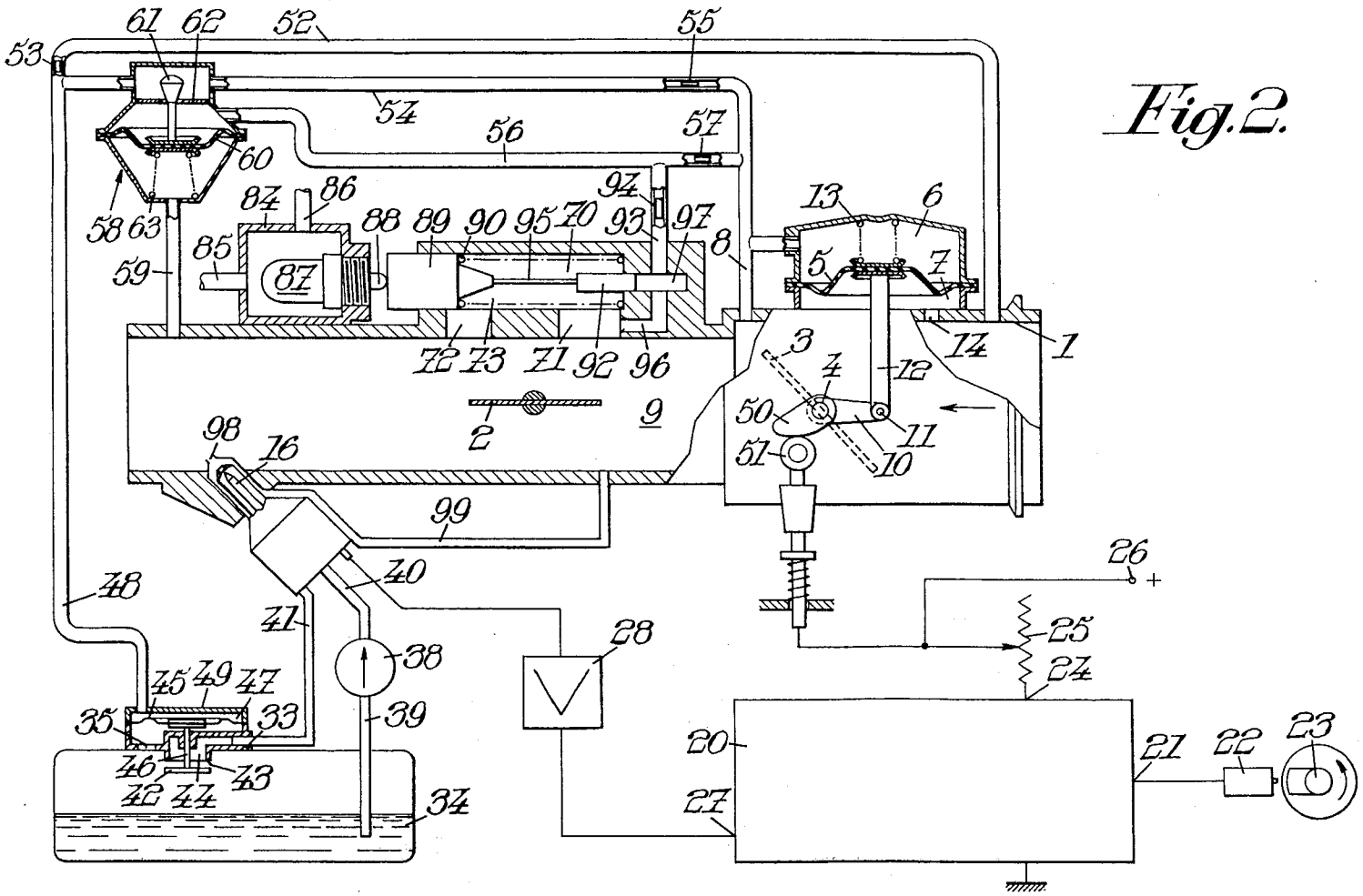
Figure 3:
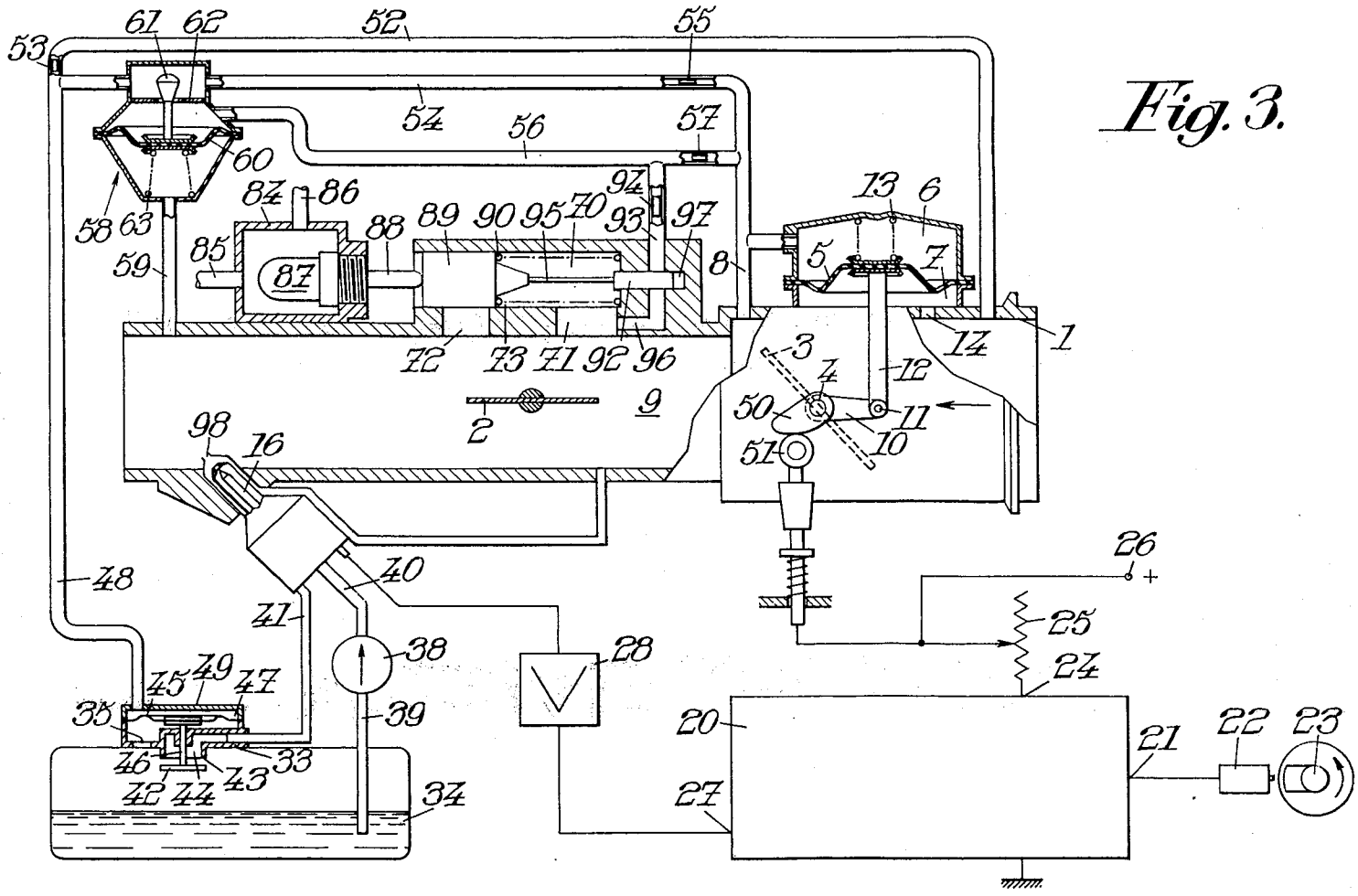

FIG. 1 is a diagram of a fuel feed device, the components of which are shown in the position corresponding to idling of an engine at a temperature below the limit temperature; and FIGS. 2 and 3, which correspond to FIG. 1, show the fuel feed device when its components are in the position corresponding to operation at full load, the engine being at a temperature below the limit temperature in FIG. 2 and above the limit temperature in FIG. 3.

Referring to the figures, the fuel feed device comprises:

auxiliary throttle means 3 which opens automatically and progressively in dependence on the increase in the air flow rate in an air intake 1; the auxiliary throttle means is disposed in air intake 1 upstream of a main throttle means consisting of a butterfly valve 2 actuated by the driver via a linkage (not shown);

means for injecting liquid fuel under pressure into a portion of pipe 1 located downstream of the main throttle means 2; and a metering system which is sensitive to the position of the auxiliary throttle means 3 and is adapted to adjust the rate of delivery of the injected fuel.

In the embodiment shown, the auxiliary throttle means 3 comprises a flap secured to a shaft 4. The flap is actuated by a pneumatic device comprising a diaphragm 5 separating two chambers 6 and 7. Chamber 6 is connected by a duct 8 to a chamber 9 comprising that part of pipe 1 between the main throttle means 2 and the auxiliary throttle means 3.

Shaft 4 is secured to a lever 10 provided at its free end with a stud 11 cooperating with that end of a rod 12 which is connected to diaphragm 5. A spring 13 constantly tends to close flap 3 against the action of the under pressure in chamber 6. Chamber 7 is connected by an aperture 14 to air intake 1 upstream of the auxiliary throttle means 3, so as to maintain a substantially atmospheric pressure in chamber 7. The angular position taken at any instant by the auxiliary throttle means 3 in pipe 1 is representative of the flow rate of air in pipe 1. If the flow rate increases, the throttle 3 opens to a corresponding extent, and chamber 9, between throttle means 2 and 3, remains at an under pressure which is substantially constant or which slightly increases, depending on the characteristics of spring 13. Although the illustrated throttle gives satisfactory results, it may be replaced by known technical equivalents such as those described in French Patent No. 1,302,537.

The injection means comprises a source of fuel under pressure which will be described in greater detail hereinafter and which has a delivery pipe 40 supplying at least one injection valve 16 opening into pipe 1 downstream of the main throttle means. Valve 16 is actuated by a solenoid or electromagnet 17 energised by rectangular current pulses periodically emitted by the metering system.

In order to protect the valve injection orifice from the pressure in pipe 1 into which valve 16 opens, the orifice opens into a chamber connected to pipe 1 upstream of butterfly valve 2 via a duct 99 having a cross-section greater than that of orifice 98 admitting fuel into the pipe.

In the embodiment shown, the metering system comprises:

a rotating member 23, which will be assumed hereinafter to be driven by the engine (although this feature is not necessary) and which, at each revolution, influences a device 22 which produces electric trigerring pulses applied at 21;

means which are sensitive to the position of the auxiliary throttle means 3 and which supply electric information at 24: in the illustrated embodiment, such means comprises an element controlled by a cam 50 and a roller 51 and moving the sliding contact of a variable resistor 25 connected to a constant-voltage source 26; and a control unit 20 receiving the input signals at 21 and 24 and supplying an injection signal to terminal 27, the signal being subsequently amplified by an amplifier 28 and fed to electromagnet 17.

The control unit may for instance comprise electronic circuits, e.g. those described and claimed in U.S. Pat. No. 3,867,913 or U.K. Pat. No. 1,266,803 to which reference may be had.

The fuel source comprises a tank 34 supplying a pump 38 having a suction pipe 39 connected to the bottom of tank 34 and a delivery pipe 40 connected to valve 16. A return or pressure-relief pipe 41 has a connection to tank 34 which is adjusted by a pressure regulator 33. Regulator 33 comprises a valve 42 cooperating with a seat 43 comprising the bottom part of a chamber 44 where the return pipe 41 ends, and also comprising a movable or deformable element, consisting of a diaphragm 45, coupled to valve 42 by a rod 46 and cooperating with cover 49 to form a chamber 47 connected to chamber 9 by a general pipe 48 and a first pipe 54 provided with a calibrated restriction 55.

That surface of diaphragm 45 which is remote from the negative-pressure chamber 47 is connected to atmospheric pressure by an orifice 35; the assembly is such that the under-pressure sampled in chamber 9 acts on diaphragm 45 and tends to close valve 42, whereas the pressure of the fuel delivered into chamber 44 acts directly on valve 42 and tends to open it.

The starting and cold-running system comprises a duct 70 which communicates via a passage 71 with that part of the air intake disposed upstream of butterfly valve 2, and via a passage 72 with that part of the air intake 1 disposed downstream of valve 2 (at least when valve 2 is closed).

The flow rate of air through duct 70 is regulated by thermostatic means, comprising a casing 84 containing connections 85, 86 for conveying a fluid (such as a lubricant or cooling fluid) at a temperature which represents the engine temperature. Casing 84 contains an element 87 which is sensitive to the fluid temperature: that element may consist of a substance contained in a closed chamber and which varies in volume in dependence on temperature, the variation in volume moving a rod 88. A valve 89 having a conical part which, with duct 70, regulates the flow cross-section 73, is driven by rod 88, against which it is held by a spring 90.

Chamber 47, in which prevails the under-pressure which actuates the relief valve 42 located in the pump relief pipe 41, is connected not only to that part of the inlet of the air intake between the main and auxiliary throttle means (chamber 9) via the first pipe 54 provided with calibration orifice 55, but is also connected:

to the inlet of air intake 1 via a second pipe 52 provided with a calibration orifice 53; and to that part of the air intake between the main and auxiliary throttle means (chamber 9) by a third pipe 56 provided with a calibration orifice 57 and having a flow cross-section controlled by a valve 61 cooperating with a seat 62 and coupled to diaphragm 60 of a capsule 58. Diaphragm 60 is subjected to the under-pressure in that part of pipe 1 downstream of the main throttle means 2, communicated by a pump 59 and to the opposing action of a spring 63 which tends to open the valve.

Means are also provided for connecting pipe 56 and passage 71 until the motor has reached a given temperature which may be about 10°C lower than the normal operating temperature. The means comprise a pipe 93 provided with a calibration orifice 94 connecting pipe 56 to a chamber 97 in which a slide valve 92 slides and is connected to valve 89 by a rod 95. Valve 92 separates pipe 93 from a pipe 96 (which connects chamber 97 to passage 71) when the engine exceeds the given temperature.

The resulting device operates as follows:

During operation under partial load, when the engine is at a temperature below the predetermined limit value, the components are in the positions shown in FIG. 1. A high amount of under-pressure prevails in that part of the air intake downstream of butterfly valve 2 and exerts a force on diaphragm 60 such that valve 61 bears against its seat 62. Consequently, the under-pressure in chamber 47 of pressure regulator 33 is slightly below the negative pressure in chamber 9, owing to the leakage through duct 52. The under-pressure in chamber 47 depends on the respective dimensions of the calibration orifices 53 and 55, which are chosen so that the resulting fuel pressure supplies the engine with an air-fuel mixture having a satisfactory composition.

When the engine operates under a heavy load, i.e., when butterfly valve 2 is substantially open (FIGS. 2 and 3) the under-pressure in that part of the air intake downstream of butterfly valve 2 is low and spring 63 raises valve 61 from its seat 62. Chamber 47 then communicates with chamber 9 not only via duct 54 but also via duct 56 provided with the calibration device 57, which decreases the relative leakage flow into duct 52 and increases the under-pressure in chamber 47 consequently the fuel pressure and the richness of the air-fuel mixture supplied to the motor, other things being equal. The enrichment resulting from the opening of valve 61 is increased, until the motor reaches the limiting temperature (FIG. 2) by the enrichment caused by the connection provided by pipes 93 and 96; since valve 92 is in a position such that pipe 93 communicates with chamber 9, there is a further reduction in the leakage via duct 52. Consequently, if the dimensions of the calibrated orifice 94 are suitably chosen, the additional connection increases the under-pressure in chamber 47 and consequently increases the richness of the air-fuel mixture under heavy load until the motor has reached the limit temperature at which slide valve 92 closes the connection.

When the engine heats up, rod 88 pushes valve 89 to the right (as shown in the drawings) so as to close duct 70, and also pushes slide valve 92 so that it blocks pipe 93, the two closure operations occuring at the same temperature or at slightly different temperatures. The closure of pipe 93 reduces the enrichment, which henceforth depends only on the calibrated orifices 57, 55 and 53. Since the enrichment is limited, the emission of polluting gases is reduced, whereas there is still a relatively large enrichment of the kind which is desirable when the engine is cold.

The invention can be varied in numerous ways. For instance, the device can comprise additional means for compensating the ambient atmospheric pressure variations, comprising e.g., a pressure-gauge capsule acting on the under-pressure in chamber 47. The control unit 20 need not be purely electronic.

I claim:

1. A fuel feed device for an internal combustion engine having an air intake passage comprising: auxiliary throttle means which opens automatically and progressively in proportion to the increase in the flow rate of air in the air intake passage, said auxiliary throttle means being disposed in said air intake passage upstream of driver actuatable main throttle means; a source of fuel under pressure having a delivery pipe which terminates in a portion of the air intake located downstream of the main throttle means and is controlled by at least one solenoid actuated valve; and a metering system sensitive to the position of the auxiliary throttle means, provided with means which, in operation, delivers a succession of pulses at time intervals and adapted to supply the solenoid valve with an energisation signal during a fraction of each time interval, the fraction being adjusted by the metering system, the delivery pipe being provided with a pressure regulator comprising a relief valve biased toward opening by the pump delivery pressure and toward closure by the under-pressure in that part of the air intake between the two throttle means, said under-pressure being transmitted by a first connecting pipe to a valve control chamber, wherein said valve control chamber is also connected to the inlet of the air intake by a second pipe and is connected to that part of the air intake between the main and auxiliary throttle means by a third pipe provided with means which opens and close it depending on whether the amount of under-pressure in that part of the air intake downstream of the main throttle means is lower or higher than a threshold and a connecting pipe is provided between the third pipe and that part of a cold start additional air duct which is disposed upstream of a cross-section thereof of adjustable area, means sensitive to the engine temperature being provided for closing the connecting pipe when the engine temperature exceeds a limit value.

2. A device according to claim 1, wherein the first, second and third pipes and the connecting pipe have calibrated orifices for adjusting the relative effects thereof on the under-pressure in the valve control chamber.

3. A device according to claim 1, wherein said temperature-sensitive means also controls the cross-sectional area of the air duct.

4. A device according to claim 1, wherein the injection fuel flow rate is rendered substantially independent of the pressure in the air intake passage downstream of the main throttle means, and the metering system is adapted to provide an energization signal during a fraction of said time interval depending substantially only on the position of the auxiliary throttle means.

5. A device according to claim 2 wherein the injection fuel flow rate is rendered substantially independent of the pressure in the air intake passage downstream of the main throttle means, and the metering system is adapted to provide and energization signal during a fraction of said time interval depending substantially only on the position of the auxiliary throttle means.

6. A device according to claim 3, wherein the injection fuel flow rate is rendered substantially independent of the pressure in the air intake passage downstream of the main throttle means, and the metering system is adapted to provide an energization signal during a fraction of said time interval depending substantially only on the position of the auxiliary throttle means.

* * * * *